US008894000B2

(12) United States Patent
Belyea et al.

(10) Patent No.: US 8,894,000 B2
(45) Date of Patent: Nov. 25, 2014

(54) BLIND CORD WINDER

(75) Inventors: Vianka P. Belyea, Boston, MA (US); Tavinder Phull, Newton, MA (US)

(73) Assignee: Rhoost LLC, Newton, MA (US)

( * ) Notice: Subject to any disclaimer, the term of this patent is extended or adjusted under 35 U.S.C. 154(b) by 167 days.

(21) Appl. No.: 13/552,386

(22) Filed: Jul. 18, 2012

(65) Prior Publication Data

US 2013/0037643 A1 Feb. 14, 2013

Related U.S. Application Data

(60) Provisional application No. 61/509,430, filed on Jul. 19, 2011.

(51) Int. Cl.

| | |
|---|---|
| ***B65H 75/38*** | (2006.01) |
| ***B65H 75/44*** | (2006.01) |
| ***E06B 9/326*** | (2006.01) |
| ***B65H 75/28*** | (2006.01) |

(52) U.S. Cl.

CPC ..... *B65H 75/28* (2013.01); *B65H 75/4473* (2013.01); *B65H 2701/35* (2013.01); *E06B 9/326* (2013.01)

USPC ..... 242/388.2; 242/405.1

(58) Field of Classification Search

CPC .... B65H 75/48; B65H 75/406; B65H 75/285; B65H 2701/35

USPC ..... 242/405.1–405.3, 388, 388.1–388.2, 242/404.3; 160/178.1 R

See application file for complete search history.

(56) References Cited

U.S. PATENT DOCUMENTS

| | | | | |
|---|---|---|---|---|
| 1,896,705 | A * | 2/1933 | Geisenhoner | 24/115 R |
| 2,204,939 | A * | 6/1940 | Lyons | 191/12 R |
| 2,351,379 | A * | 6/1944 | Wehringer | 242/388 |
| 2,683,937 | A * | 7/1954 | Criswell | 33/393 |
| 3,626,495 | A * | 12/1971 | Bastian, Jr. | 242/405.2 |
| 6,484,787 | B1 * | 11/2002 | Walters | 160/178.1 R |
| 7,651,047 | B2 * | 1/2010 | Peng et al. | 242/587.2 |

* cited by examiner

*Primary Examiner* — Sang Kim

(74) *Attorney, Agent, or Firm* — Wilmer Cutler Pickering Hale and Dorr LLP

(57) ABSTRACT

A cord winder device that may be used to shorten the length of a pull cord that hangs from a window covering, such that it can adjust the exposed length of window blinds. The cord winder device includes a spindle and sides that overlap the spindle. A cord hanging from the window covering may be wound around the spindle so that the length of the cord is reduced. Reducing the height of the cord may keep the cord out of reach of children and prevent injury. The sides of the spindle may have slots to secure the cord to the cord winder device after it is wound around the spindle.

20 Claims, 9 Drawing Sheets

BLIND CORD WINDER

CROSS-REFERENCE TO RELATED APPLICATION

This application claims the benefit of U.S. Provisional Application No. 61/509,430, filed Jul. 19, 2011, the entire contents of which are hereby incorporated by reference.

BACKGROUND

This disclosure generally relates to safety devices for window coverings.

Window blinds, shades, and curtains are available in a variety of styles. Window treatments often have a top rail or rod, and, in the case of many horizontal blinds, a bottom rail. Shading material either hangs from the top rail, or between the top and bottom rails if there are multiple rails. The shading material can be vertical or horizontal slats, paper, mesh, or fabric. Pull cords are often used to adjust the amount of material covering the window to permit more or less light to pass through the window. Many window coverings use long looping pull cords or two-end pull cord that dangle in front of or beside the window covering. Because these cords dangle near the floor within children's reach, they present a household danger. People, and especially children, can be strangled, choke, or become tangled in dangling pull cords.

Some devices that keep cords out of children's reach require that the device be mounted on a wall with screws or adhesive, and are therefore aesthetically unpleasing, some require tools to install or uninstall, and can damage walls to which they are affixed. Further, many currently-available devices use pulleys, wheels, or complicated multi-piece assemblies that make the devices difficult to use and more expensive to make.

The device can be made as an inexpensive, simple, one-piece blind cord winder device that does not require mounting or complicated methods for winding cords to keep them out of children's reach.

SUMMARY

The blind cord winder described here can be simple, inexpensive, and can be made as a one-piece device for raising dangling pull cords out of children's reach by allowing pull cords to be wound around and secured to the device.

The blind cord winder includes, and can consist or consist essentially of, a top portion, a bottom portion, and a spindle. The top and bottom portions are separated by the spindle. Pull cords are wound around the spindle and the top and bottom portions hold the wound cord in place. The bottom portion can have slots, which can terminate in notches, to help secure ends of pull cords to the device.

The size of the blind cord winder can vary depending on the length and thickness of the pull cord it is configured to accept. The blind cord winder can be any general shape, and can be made out of a substantially rigid material such as plastic.

BRIEF DESCRIPTION OF THE DRAWINGS

The following figures are provided for the purpose of illustration only and are not intended to be limiting.

DETAILED DESCRIPTION

Figure 7:
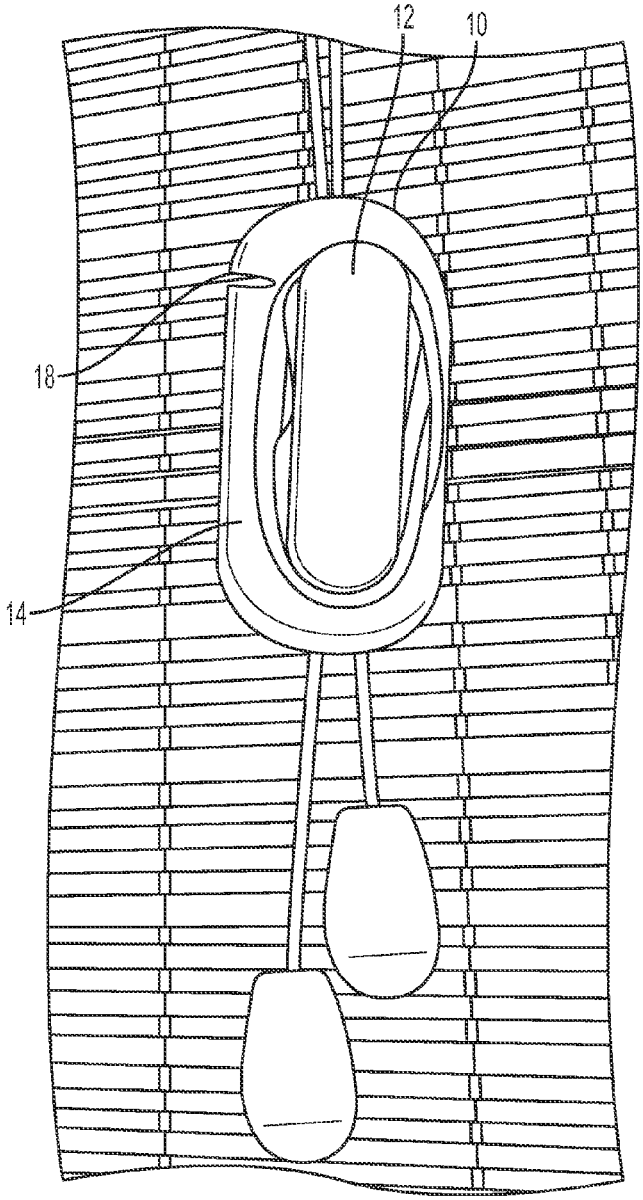
FIG. 7 is a side perspective view of the blind cord winder in operation.

A blind cord winder device 10 around which pull cords (e.g., of the type commonly used to open and close window coverings) are wrapped. A portion of a pull cord is wound around and secured to the device 10 to keep ends of cords out of children's reach to prevent children from choking on, being strangled by, or tangled in dangling cords. The blind cord winder 10 hangs freely from cords as shown in FIG. 7, and optionally can be mounted on or affixed to walls or other surfaces. The one-piece configuration makes the device 10 simple to use and inexpensive to make.

Figure 1:
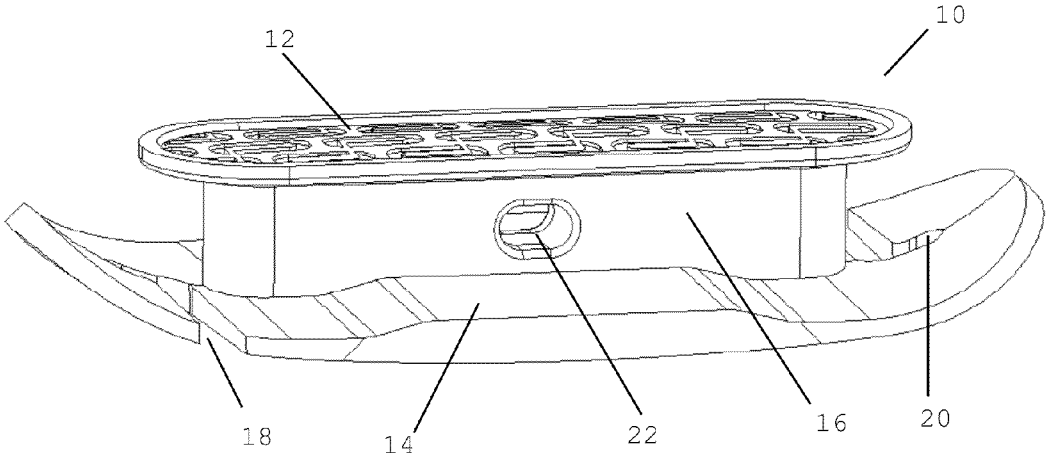
FIG. 1 is a side perspective view of the blind cord winder.
Figure 2:
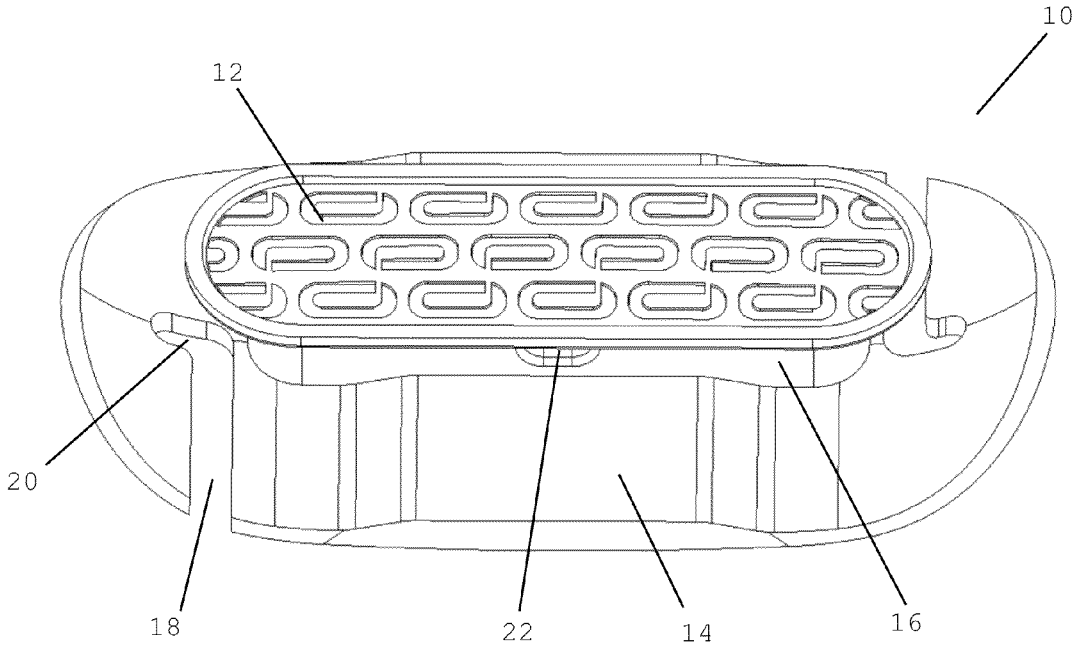
FIG. 2 is a top perspective view of the blind cord winder.
Figure 3:
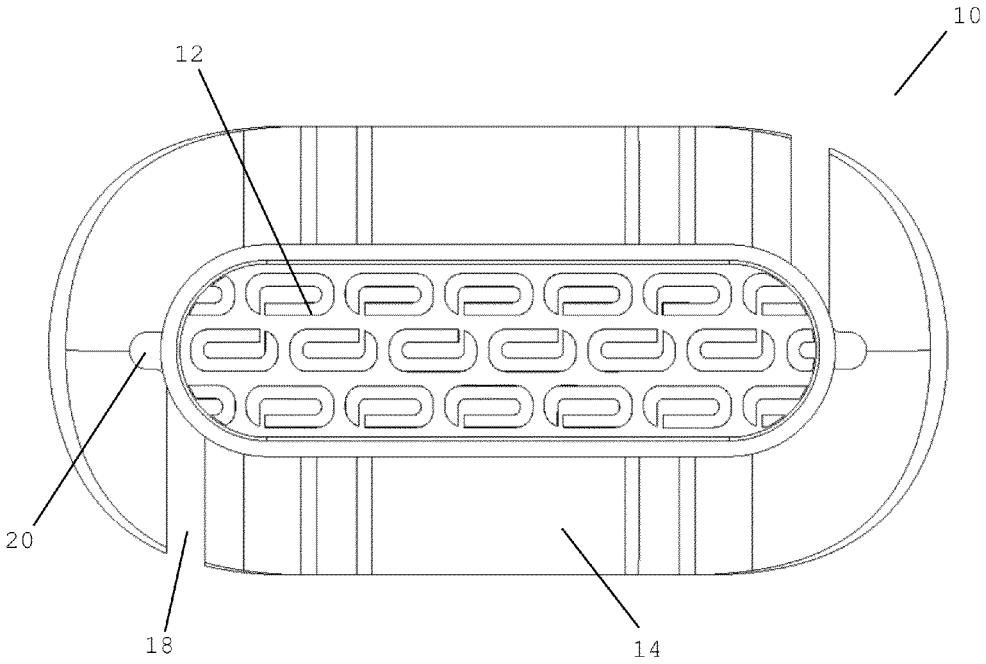
FIG. 3 is a top view of the blind cord winder.
Figure 4:
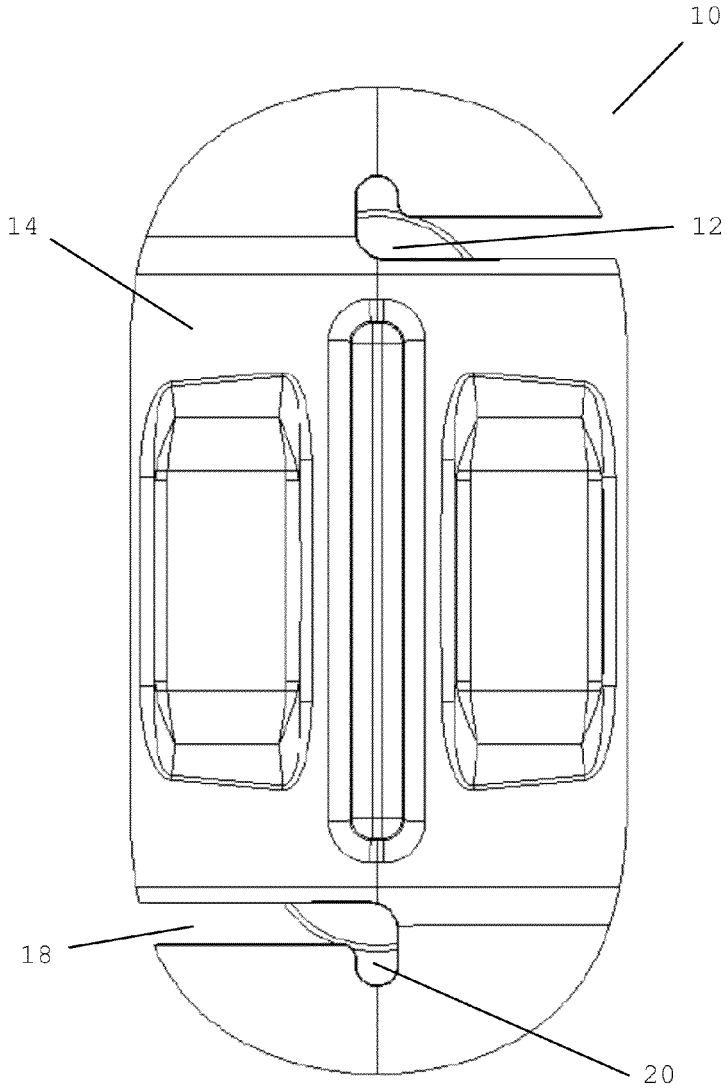
FIG. 4 is a bottom view of the blind cord winder.
Figure 8:
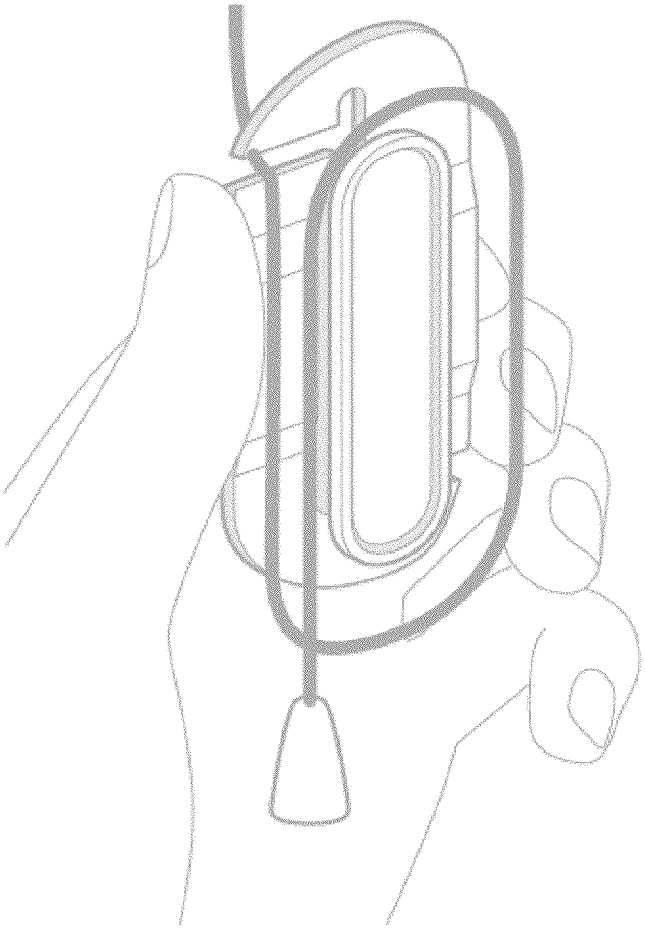
FIG. 8 is a side perspective view of the blind cord winder in operation.

Referring to FIG. 1, the blind cord winder 10 has a top portion 12 and a bottom portion 14, which are separated by a spindle 16. As shown in FIG. 8, the pull cord is wound around the spindle 16 and between the top portion 12 and bottom portion 14 to prevent the wound cord from slipping off the spindle 16. Further, in some embodiments such as shown in FIG. 4, the bottom portion 14 has one or more slots 18 for receiving a portion of the pull cord to secure the cord in place. The slots 18 are openings at the outer edge of the bottom portion 14 that extend into the body of the bottom portion 14. Referring again to FIG. 4, the bottom portion 14 may also have slots 18 that terminate in one or more notches 20, which further help to prevent unwinding. The length of the notches 20 generally runs perpendicular to the length of the slots 18. However, the notches 20 can be configured in any direction skewed from the slots and capable of securing cords. The spindle 16 optionally has openings 22 as shown in FIG. 1. The openings 22 help prevent complete blockage of the airway in the event a child swallows the device 10.

Figure 5:
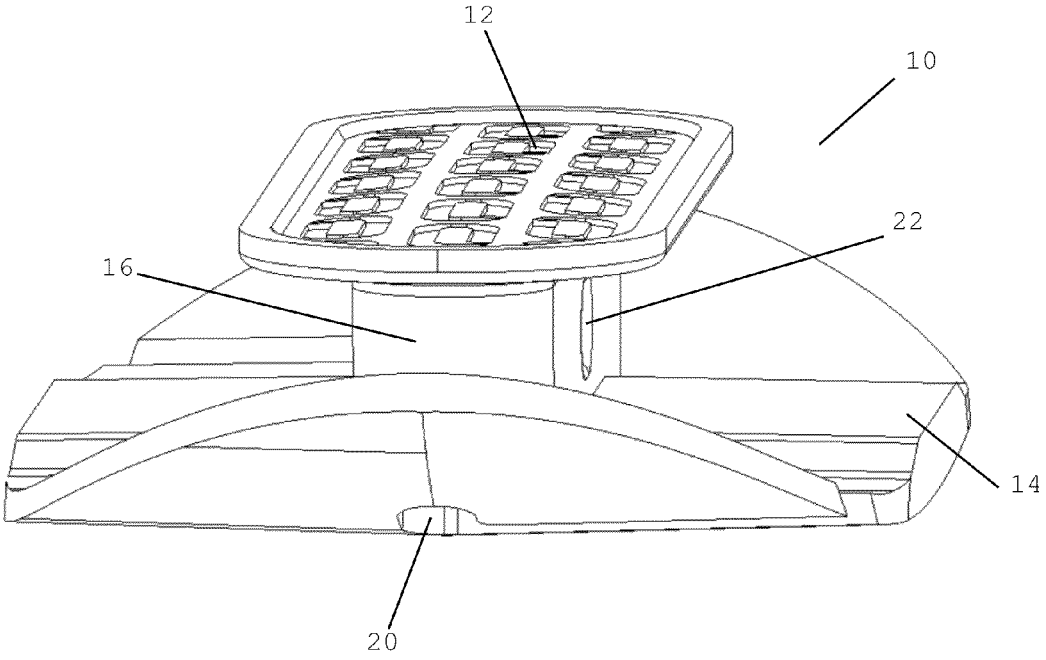
FIG. 5 is an end perspective view of the blind cord winder.
Figure 6:
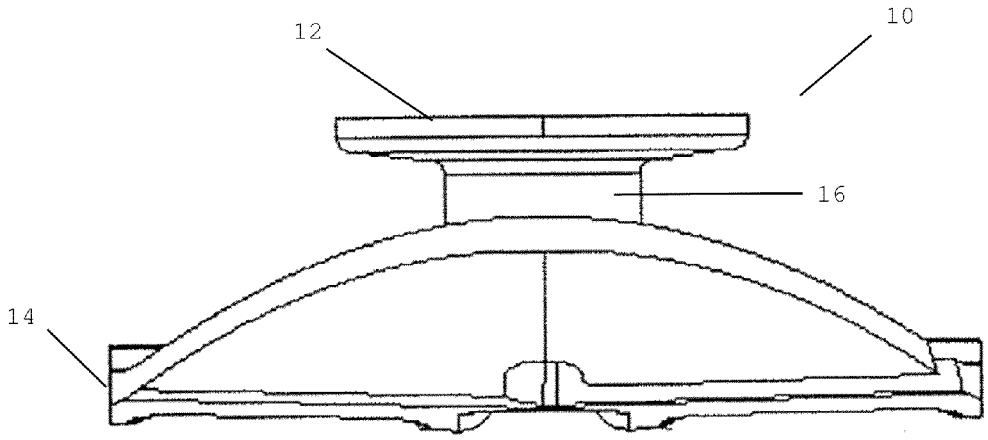
FIG. 6 is an end view of the blind cord winder.

The blind cord winder 10 can have any general shape. For example, FIGS. 1-6 show a top portion 12 and a bottom portion 14 that are oval shaped. The bottom portion 14 and top portion 12 are generally planar. In addition, in some embodiments, the bottom portion 14 has raised ends or sides to help keep pull cords wrapped around the device 10. For example, FIGS. 1, 5, and 6 show a generally planar bottom portion 14 with two ends that are each raised at an incline.

Figure 9:
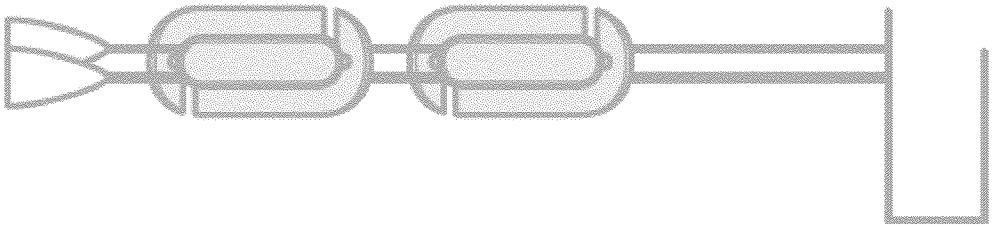
FIG. 9 is a front view of two blind cord winders in operation.

The dimensions of the top and the bottom portions 12, 14 are greater than that of the spindle 16. However, the dimensions of the top portion 12 can be greater than, less than, or the same as the dimensions of the bottom portion 14. The thickness of the spindle 16 and size of the top and bottom portions 12, 14 vary depending on the length and thickness of the cord it is configured to accommodate. For example, a thicker cord, such as a chain or beaded pull cord, may require a larger top portion 12, larger bottom portion 14, or a smaller spindle 16 than a pull cord made of thin rope. As shown in FIG. 9, two or more blind cord winders 10 can be used to raise long cords out of children's reach.

The top portion 12, bottom portion 14, and spindle 16 can be fabricated as a single piece or as multiple components permanently joined by adhesive or some other fastening means. The blind cord winder 10 can be made of any substantially rigid material, preferably, but not necessarily a substantially rigid, light-weight material. In a one embodiment, the blind cord winder 10 is made of plastic, such as acrylonitrile butadiene styrene plastic, commonly known as ABS plastic.

In another embodiment, the blind cord winder 10 can be made of hard rubber, metal, wood or any other substantially rigid material.

As will be apparent, the embodiments can be provided forms other than those specifically disclosed above. The particular embodiments described above are, therefore, to be considered as illustrative and not restrictive. Those skilled in the art will recognize, or be able to ascertain, equivalents to the specific embodiments described herein. For example, the top portion 12 and bottom portion 14 of the blind cord winder 10 can be configured to have any general shape capable of holding pull cords in place, including an oval, circular, rectangular, triangular, or square-shaped. The top portion 12 and bottom portion 14 can be the same or different shapes. Similarly, the width and overall shape of the spindle 16 can vary.

What is claimed is:

1. A cord winder device comprising:

a substantially planar top piece;

a substantially planar bottom piece that is parallel to the top piece, wherein one of the top piece and the bottom piece has ends that are angled toward the other of the bottom piece and the top piece; and a spindle perpendicular to the top piece and extending from the top piece to the bottom piece;

the bottom piece including an outer edge, and further including a first slot and a second slot, each of the first and second slots extending inwardly from the outer edge of the bottom piece.

2. The cord winder device of claim 1, wherein at least one of the first slot and the second slot terminates in a notch running at a skewed angle to the direction of the respective slot.

3. The cord winder device of claim 1, wherein at least one of the top piece and the bottom piece are elongated along a first direction.

4. The cord winder device of claim 3, wherein the top piece and the bottom piece are each elongated along the first direction.

5. The cord winder device of claim 1, wherein the spindle has a hole that extends parallel to the top piece.

6. The cord winder device of claim 1, wherein the cord winder device is made of substantially rigid material.

7. The cord winder device of claim 1, wherein the cord winder device is made of one of plastic, hard rubber, metal, or wood.

8. The cord winder device of claim 1, wherein the cord winder device is made of one monolithic piece.

9. The cord winder device of claim 1, wherein the cord winder device is made of acrylonitrile butadiene styrene (ABS) plastic.

10. The cord winder device of claim 1, wherein the bottom piece has an exterior face that is shaped to be mountable on a wall.

11. The cord winder device of claim 1, wherein the slots extend inwardly from opposite ends and opposite sides of the bottom piece.

12. A method of reducing the length of a pull cord hanging from a window covering using the cord winder device of claim 1, the method comprising winding a length of the cord around an outer surface of the spindle and allowing the cord winder device to hang freely from the window covering while attached to the cord.

13. The method of claim 12, further comprising inserting one or more lengths of the cord into at least one of the first slot and the second slot of the cord winder device to secure the cord to the cord winder device.

14. The cord winder of claim 1, in combination with a blind cord having a first end coupled to a window treatment and a second free end, the blind cord wrapped around the spindle and having a portion in the first slot.

15. A cord winder device comprising:

a substantially planar top piece;

a substantially planar bottom pieces;

a spindle extending between the top piece and the bottom piece;

wherein the top piece and the bottom piece are each elongated along a first direction, wherein one of the top and bottom pieces has an inwardly extending slot, and one of the top piece and the bottom piece has ends that are angled toward the other of the bottom piece and the top piece.

16. The cord winder device of claim 15, wherein the slot terminates in a notch running at a skewed angle to the direction of the slot.

17. The cord winder device of claim 15, wherein the spindle has a hole ending through the spindle.

18. The cord winder device of claim 15, wherein the cord winder device is made of substantially rigid material.

19. The cord winder device of claim 15, wherein the cord winder device is made of one monolithic piece.

20. The cord winder of claim 15, in combination with a blind cord having a first end coupled to a window treatment and a second free end, the blind cord wrapped around the spindle and having a portion in the slot.

* * * * *